US011703055B2

(12) United States Patent
Shin et al.

(10) Patent No.: US 11,703,055 B2
(45) Date of Patent: Jul. 18, 2023

(54) ROTARY COMPRESSOR INCLUDING A BEARING CONTAINING AN ASYMMETRICAL POCKET TO IMPROVE COMPRESSOR EFFICIENCY

(71) Applicant: LG ELECTRONICS INC., Seoul (KR)

(72) Inventors: Jinung Shin, Seoul (KR); Seoungmin Kang, Seoul (KR); Joonhong Park, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 176 days.

(21) Appl. No.: 17/183,505

(22) Filed: Feb. 24, 2021

(65) Prior Publication Data

US 2021/0363990 A1 Nov. 25, 2021

(30) Foreign Application Priority Data

May 22, 2020 (KR) ..... 10-2020-0061630

(51) Int. Cl.
*F04C 18/356* (2006.01)
*F04C 29/12* (2006.01)

(52) U.S. Cl.
CPC ..... *F04C 18/3564* (2013.01); *F04C 29/12* (2013.01); *F04C 2240/20* (2013.01);
(Continued)

(58) Field of Classification Search
CPC .. F04C 18/3564; F04C 29/12; F04C 2240/20; F04C 2240/50; F04C 2240/60; F05B 2210/12; F05B 2240/20; F05B 2240/50
See application file for complete search history.

(56) References Cited

U.S. PATENT DOCUMENTS 2,650,754 A 9/1953 Simon
4,410,305 A 10/1983 Shank et al.
(Continued)

FOREIGN PATENT DOCUMENTS

DE 10 2006 012868 9/2007
DE 10 2013 223999 5/2015
(Continued)

OTHER PUBLICATIONS

English Machine Translation of WO2020042435A1 (Year: 2020).*
(Continued)

*Primary Examiner* — Dominick L Plakkoottam
*Assistant Examiner* — Paul W Thiede
(74) *Attorney, Agent, or Firm* — Ked & Associates

(57) ABSTRACT

A rotary compressor is provided that may include a rotational shaft, first and second bearings configured to support the rotational shaft in a radial direction, a cylinder disposed between the first and second bearings to form a compression space, a rotor disposed in the compression space and coupled to the rotational shaft to compress a refrigerant as the rotor rotates, and at least one vane slidably inserted into the rotor, the at least one vane coming into contact with an inner peripheral surface of the cylinder to separate the compression space into a plurality of regions. At least one of the first bearing and the second bearing may include first and second pockets formed on a surface facing the rotor, and at least one of the first pocket and the second pocket may be formed in an asymmetrical shape.

16 Claims, 12 Drawing Sheets

(52) U.S. Cl.
CPC ..... *F04C 2240/50* (2013.01); *F04C 2240/60* (2013.01); *F05B 2210/12* (2013.01); *F05B 2240/20* (2013.01); *F05B 2240/50* (2013.01)

(56) References Cited

U.S. PATENT DOCUMENTS

| | | | | |
|---|---|---|---|---|
| 4,521,167 | A | 6/1985 | Cavalleri et al. | |
| 4,799,867 | A | 1/1989 | Sakamaki et al. | |
| 4,859,163 | A | 8/1989 | Schuller | |
| 4,886,392 | A | 12/1989 | Iio | |
| 5,160,252 | A | 11/1992 | Edwards | |
| 5,302,096 | A | 4/1994 | Cavalleri | |
| 9,115,716 | B2 | 8/2015 | Sekiya et al. | |
| 2009/0285709 | A1 | 11/2009 | Mooy et al. | |
| 2012/0009078 | A1 | 1/2012 | Maeyama | |
| 2013/0149178 | A1 | 6/2013 | Sekiya | |
| 2014/0140866 | A1 | 5/2014 | Pfister et al. | |
| 2016/0333877 | A1* | 11/2016 | Tsuda | F04C 29/0064 |
| 2020/0158111 | A1* | 5/2020 | Park | F01C 21/0863 |
| 2021/0301818 | A1 | 9/2021 | Moon | |

FOREIGN PATENT DOCUMENTS

| | | | | |
|---|---|---|---|---|
| EP | 2 219 917 | | 12/2011 | |
| JP | S58-8201 | | 1/1983 | |
| JP | 2002-039084 | | 2/2002 | |
| JP | 2002-155878 | | 5/2002 | |
| JP | 2006-152903 | | 6/2006 | |
| JP | 2015-117608 | | 6/2015 | |
| KR | 20-1999-0014251 | | 4/1999 | |
| KR | 10-2011-0106045 | | 9/2011 | |
| KR | 10-2012-0112790 | | 10/2012 | |
| KR | 10-2018-0094411 | | 8/2018 | |
| KR | 10-2020-0054026 | | 5/2020 | |
| KR | 20200054026 | A * | 5/2020 | |
| WO | WO 95/35431 | | 12/1995 | |
| WO | WO 2013/105463 | | 7/2013 | |
| WO | WO-2013105463 | A1 * | 7/2013 | F01C 21/0836 |
| WO | WO 2020/042435 | | 3/2020 | |
| WO | WO-2020173118 | A1 * | 9/2020 | F04C 18/344 |

OTHER PUBLICATIONS

English Machine Translation of JP2015117608A (Year: 2015).*
English Machine Translation of KR20200054026A (Year: 2020).*
U.S. Office Action dated Jun. 23, 2022 issued in U.S. Appl. No. 17/179,708.
Korean Office Action dated Jun. 15, 2021 (61626).
Korean Office Action dated Jun. 15, 2021 (61630).
European Search Report issued in Application No. 21165131.0 dated Aug. 13, 2021.
U.S. Office Action dated Apr. 8, 2022 issued in U.S. Appl. No. 17/177,683.
European Search Report issued in Application No. 21164461.2 dated Jun. 4, 2021.
Korean Office Action dated Aug. 20, 2021 issued in Application No. 10-2020-0082373.
European Search Report dated Oct. 4, 2021 issued in Application No. 21171474.6.
Korean Office Action dated Mar. 23, 2021.
U.S. Office Action dated Aug. 5, 2022 issued in U.S. Appl. No. 17/181,076.

* cited by examiner

ROTARY COMPRESSOR INCLUDING A BEARING CONTAINING AN ASYMMETRICAL POCKET TO IMPROVE COMPRESSOR EFFICIENCY

CROSS-REFERENCE TO RELATED APPLICATION(S)

This application claims priority under 35 U.S.C. § 119 to Korean Application No. 10-2020-0061630 filed on May 22, 2020, whose entire disclosure is hereby incorporated by reference.

BACKGROUND

1. Field

A rotary compressor is disclosed herein.

2. Background

In general, a compressor refers to a device configured to receive power from a power generating device, such as a motor or a turbine, and compress a working fluid, such as air or a refrigerant. More specifically, the compressor is widely applied to the entire industry of home appliances, in particular, a vapor compression type refrigeration cycle (hereinafter referred to as a "refrigeration cycle").

Compressors may be classified into a reciprocating compressor, a rotary compressor, or a scroll compressor according to a method of compressing the refrigerant. A compression method of the rotary compressor may be classified into a method in which a vane is slidably inserted into a cylinder to come into contact with a roller, and a method in which a vane is slidably inserted into a roller to come into contact with a cylinder. In general, the former is referred to as a rotary compressor and the latter is referred to as a vane rotary compressor.

In the rotary compressor, the vane inserted into the cylinder is drawn out toward the roller by an elastic force or a back pressure, and comes into contact with an outer peripheral surface of the roller. In the vane rotary compressor, the vane inserted into the roller rotates with the roller and is drawn out by a centrifugal force and a back pressure, and comes into contact with an inner peripheral surface of the cylinder.

In the rotary compressor, compression chambers as many as a number of vanes per rotation of the roller are independently formed, and the respective compression chambers perform suction, compression, and discharge strokes at the same time. In the vane rotary compressor, compression chambers as many as a number of vanes per rotation of the roller are continuously formed, and the respective compression chambers sequentially perform suction, compression, and discharge strokes.

In the vane rotary compressor, in general, a plurality of vanes rotates together with the roller and slide in a state in which a distal end surface of the vane is in contact with the inner peripheral surface of the cylinder, and thus, friction loss increases compared to a general rotary compressor. In addition, in the vane rotary compressor, the inner peripheral surface of the cylinder is formed in a circular shape. However, recently, a vane rotary compressor (hereinafter, referred to as a "hybrid rotary compressor") has been introduced, which has a so-called hybrid cylinder an inner peripheral surface of which is formed in an ellipse or a combination of an ellipse and a circle, and thus, friction loss is reduced and compression efficiency improved.

In the hybrid rotary compressor, the inner peripheral surface of the cylinder is formed in an asymmetrical shape. Accordingly, a location of a contact point which separates a region where a refrigerant flows in and a compression strokes starts and a region where a discharge stroke of a compressed refrigerant is performed has a great influence on efficiency of the compressor.

In particular, in a structure in which a suction port and a discharge port are sequentially formed adjacent to each other in a direction opposite to a rotational direction of the roller in order to achieve a high compression ratio by increasing a compression path as much as possible, the position of the contact point greatly affects the efficiency of the compressor. However, a separation space is generated between the vane and the cylinder, and thus, compression efficiency decreases.

BRIEF DESCRIPTION OF THE DRAWINGS

Embodiments will be described in detail with reference to the following drawings in which like reference numerals refer to like elements, and wherein.

DETAILED DESCRIPTION

Figure 1:
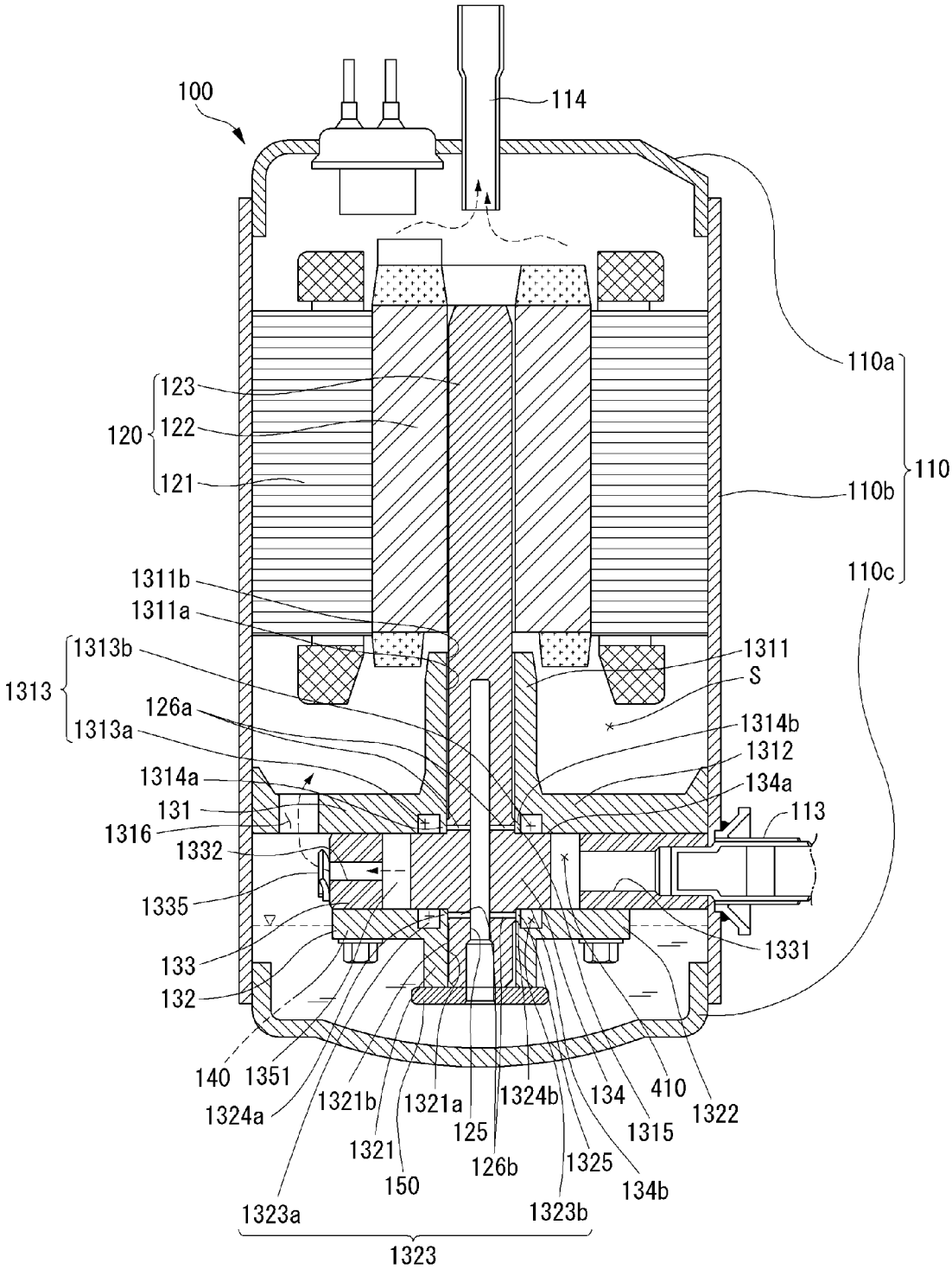
FIG. 1 is a vertical cross-sectional view of a rotary compressor according to an embodiment.

Hereinafter, embodiments will be described with reference to the accompanying drawings. Wherever possible, the same or similar components have been assigned the same or similar reference numerals, and repetitive description has been omitted.

In describing embodiments, when a component is referred to as being "coupled" or "connected" to another component, it should be understood that the component may be directly coupled to or connected to another component, both different components may exist therebetween.

In addition, in describing embodiments, if it is determined that description of related known technologies may obscure the gist of embodiments, the description will be omitted. In addition, the accompanying drawings are for easy understanding of the embodiments, and a technical idea disclosed is not limited by the accompanying drawings, and it is to be understood as including all changes, equivalents, or substitutes falling within the spirit and scope.

Meanwhile, terms of the specification can be replaced with terms such as document, specification, description.

Figure 2:
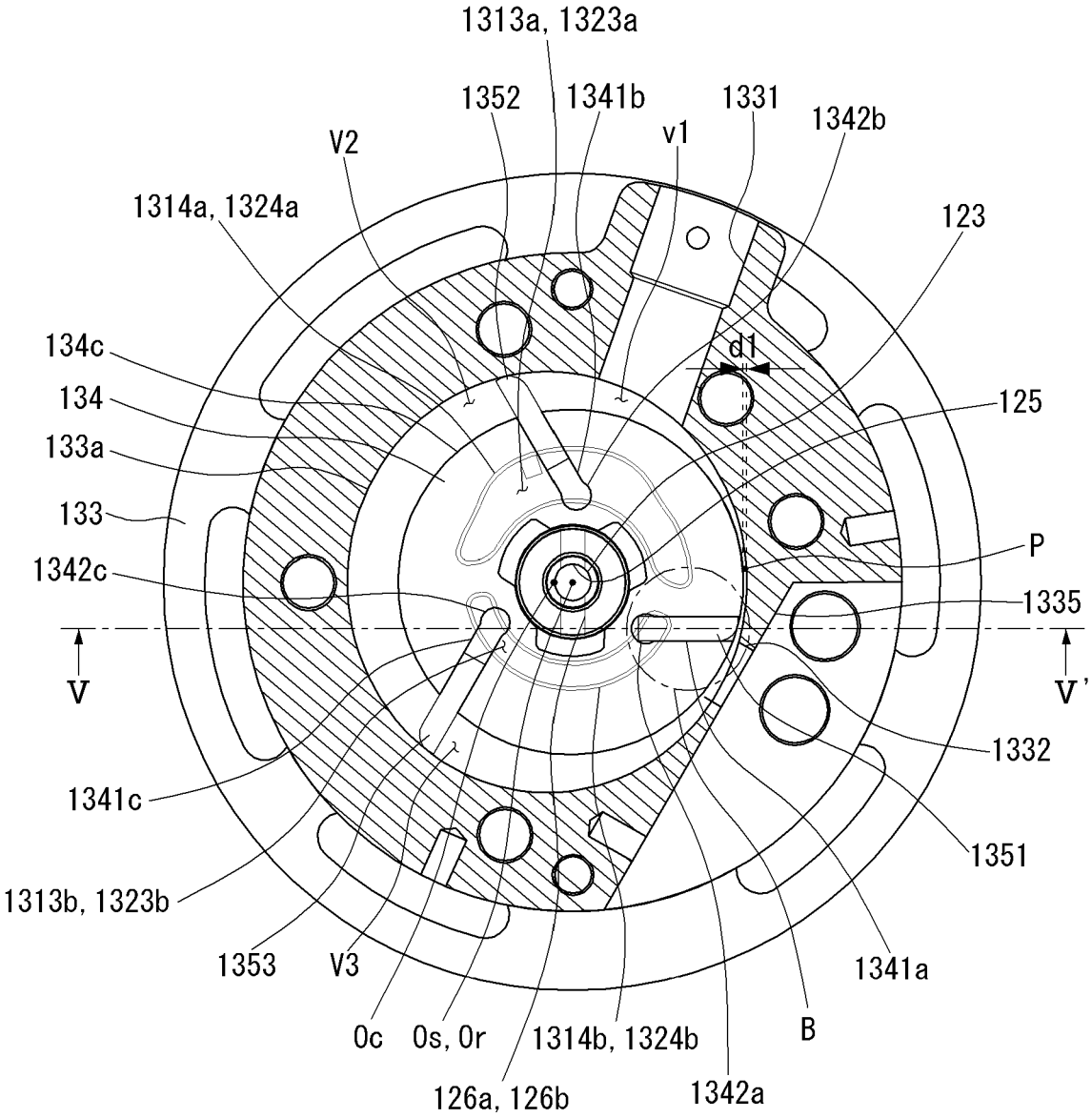
FIG. 2 is a transverse cross-sectional view of the rotary compressor according to an embodiment.
Figure 3:
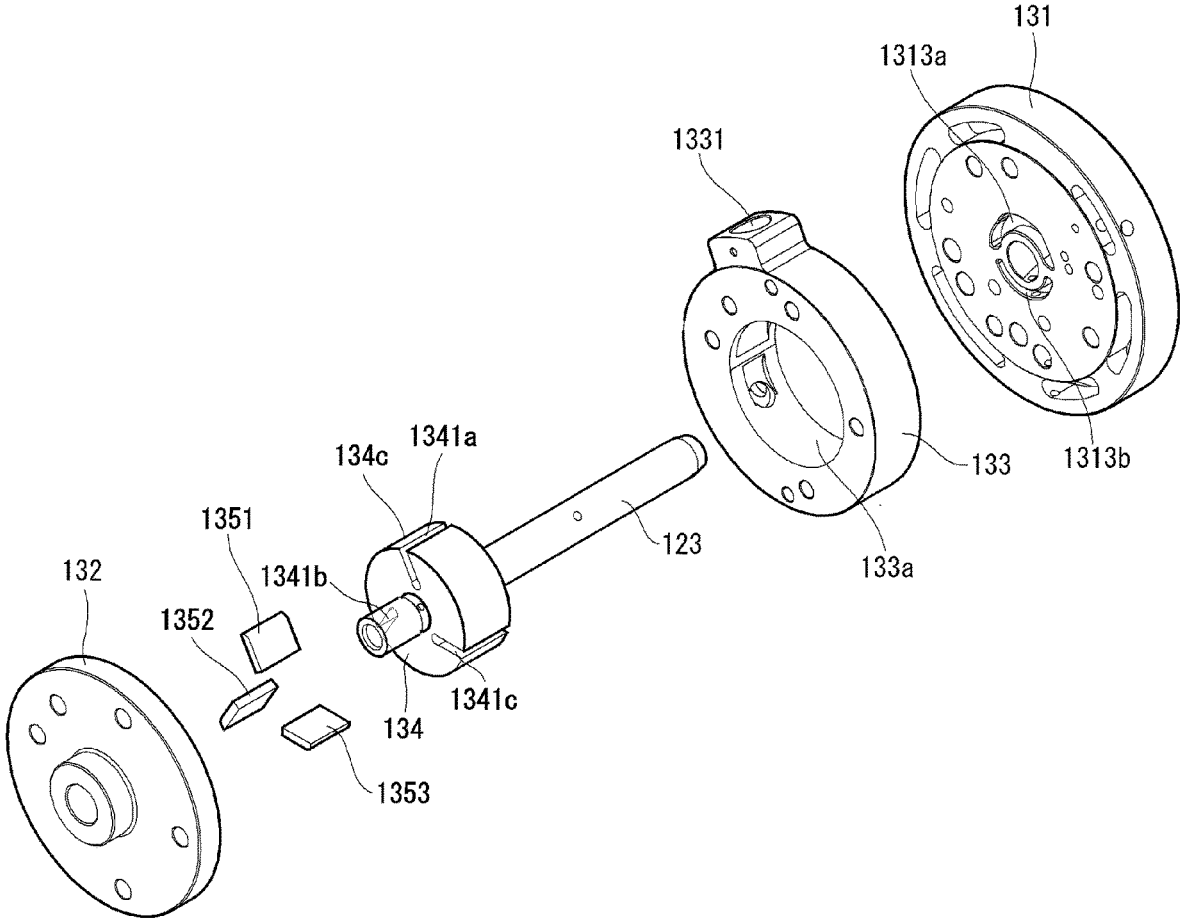
FIGS. 3 and 4 are exploded perspective views of a partial configuration of the rotary compressor according to an embodiment.
Figure 4:
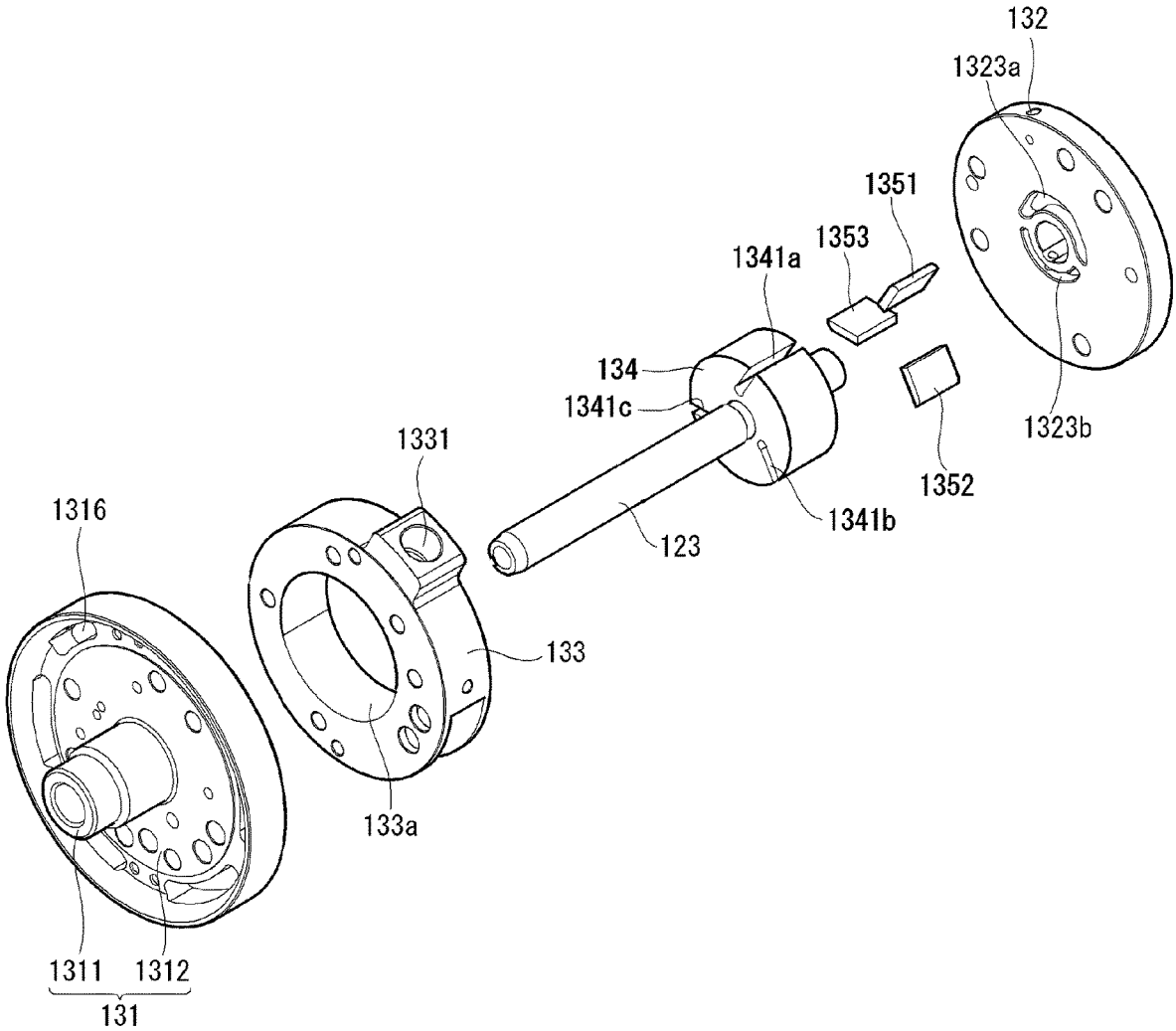
Figure 5:
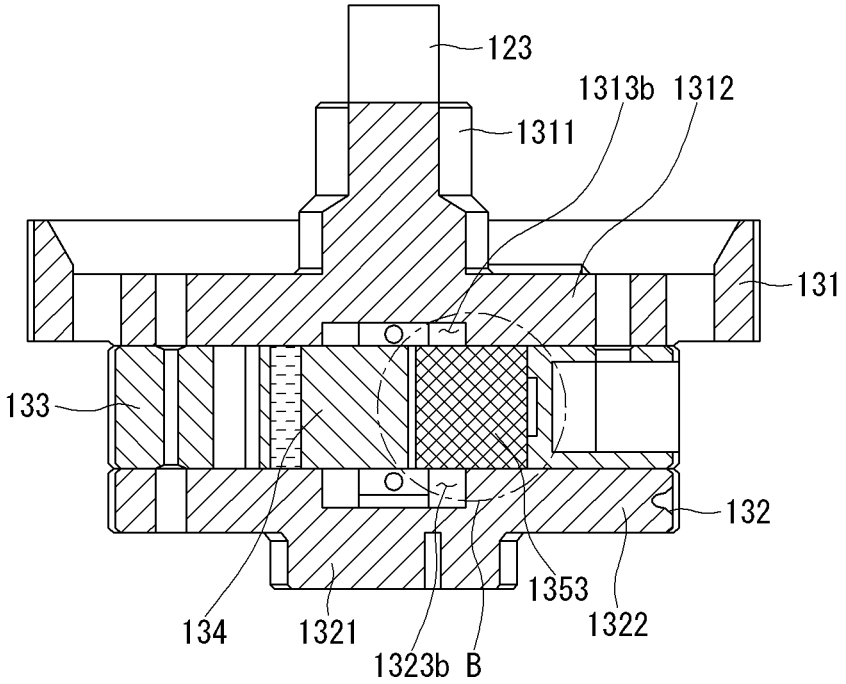
FIG. 5 is a cross-sectional view, taken along line V-V' of FIG. 2.
Figure 6:
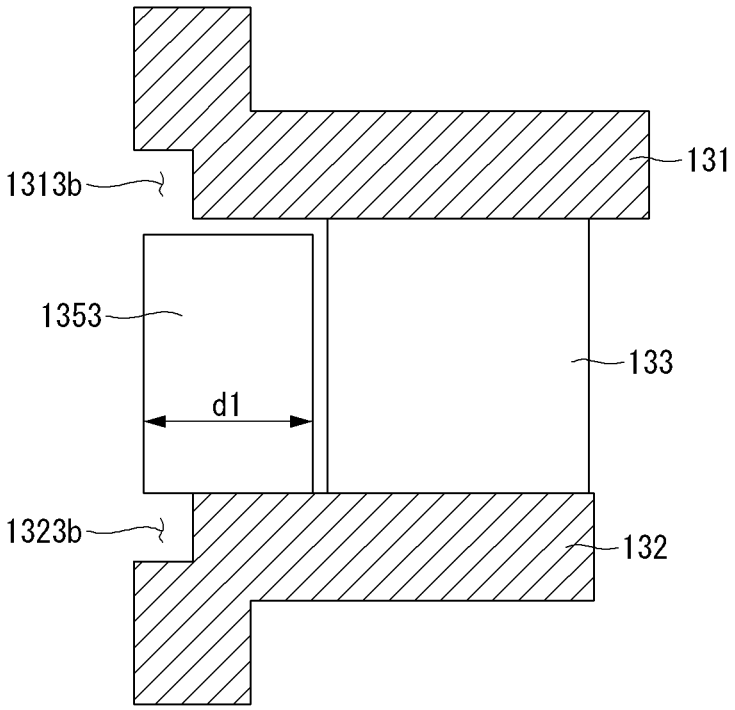
FIGS. 6 and 7 are enlarged views of portion B of FIG. 5.
Figure 7:
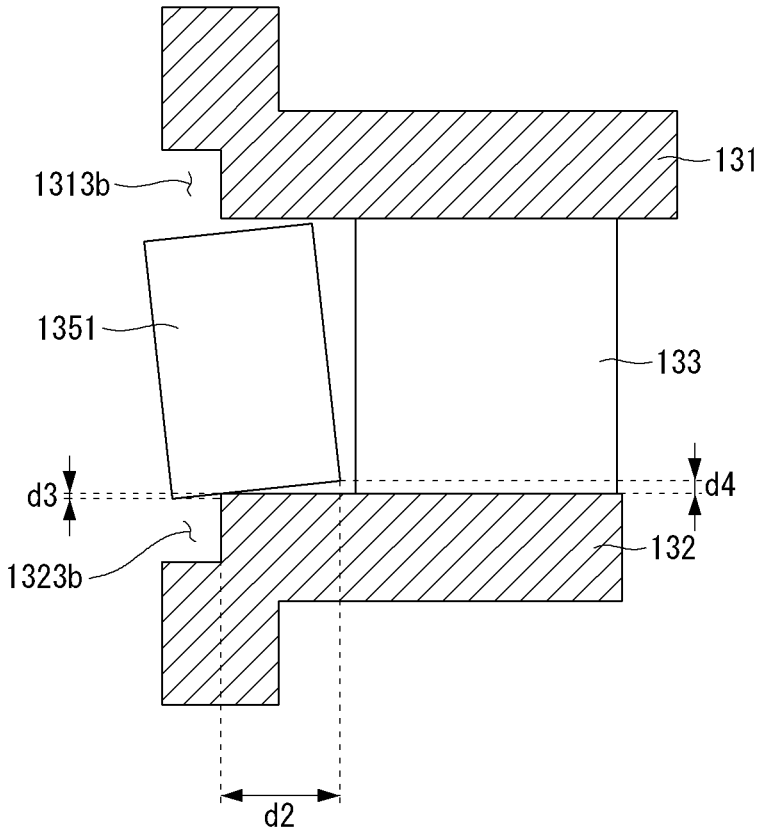
Figure 8:
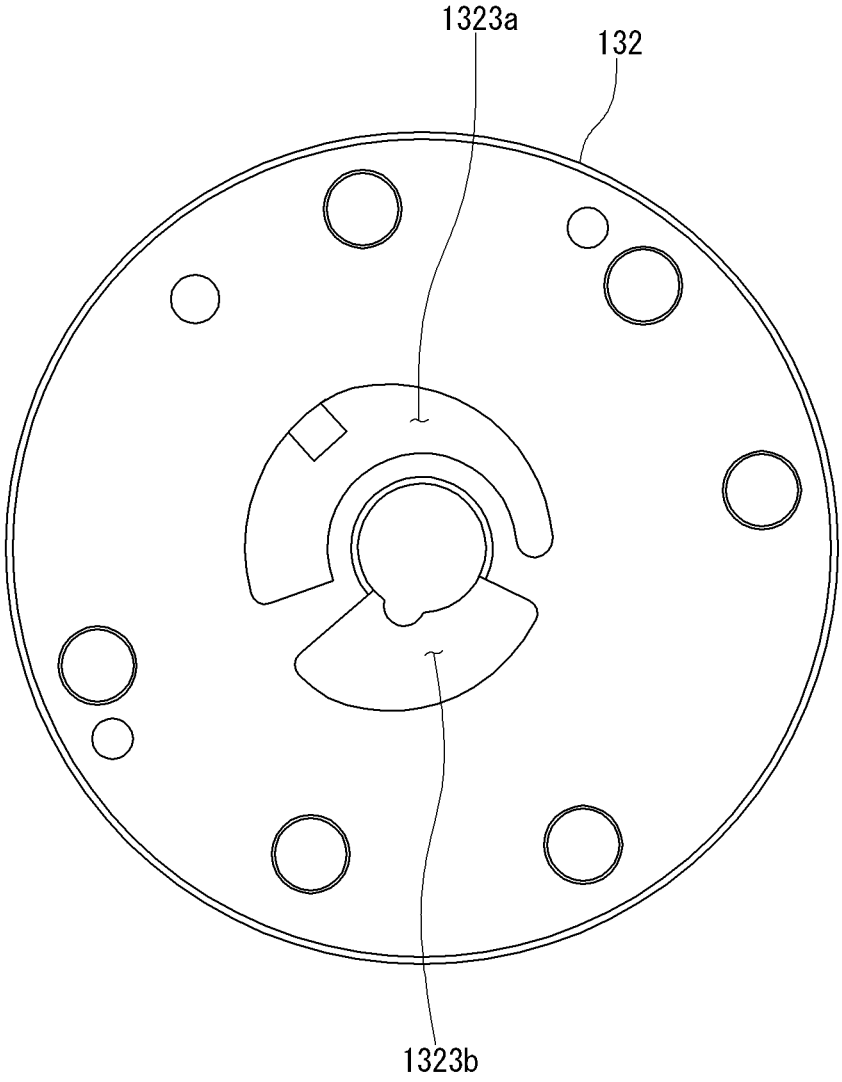
FIGS. 8 and 9 are plan views of a partial configuration of the rotary compressor according to an embodiment.
Figure 9:
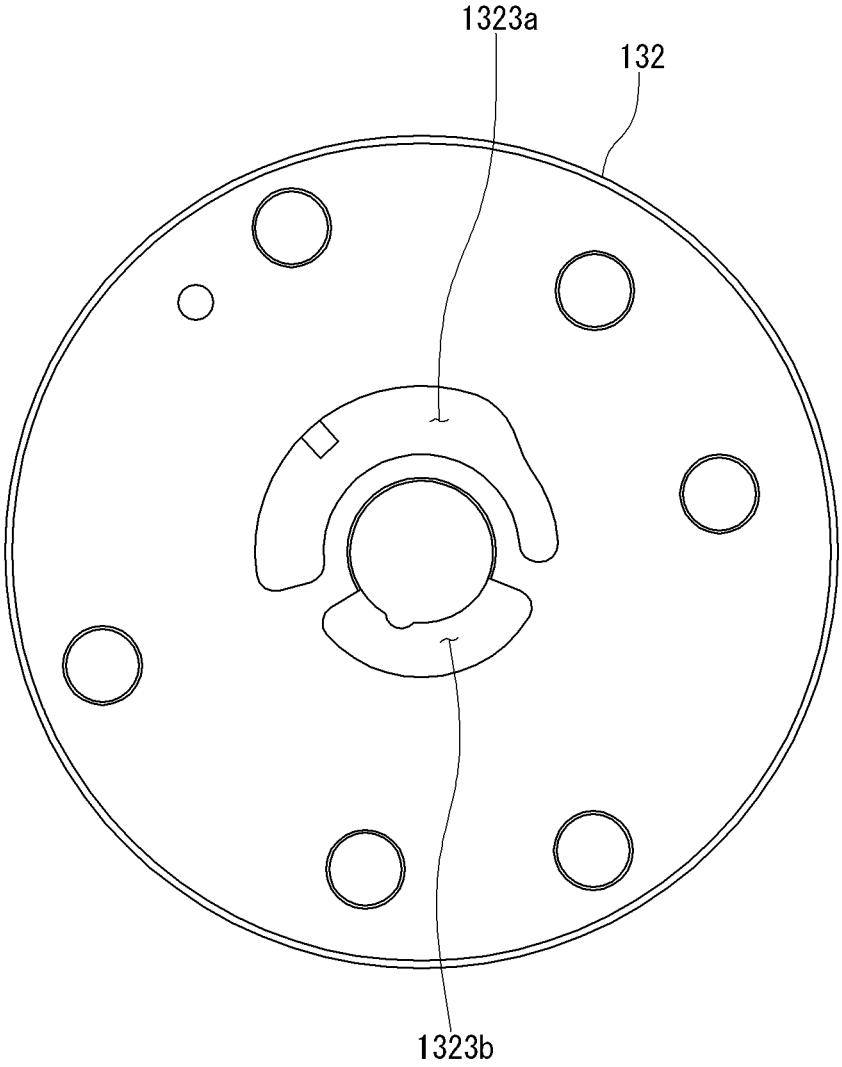
Figure 10:
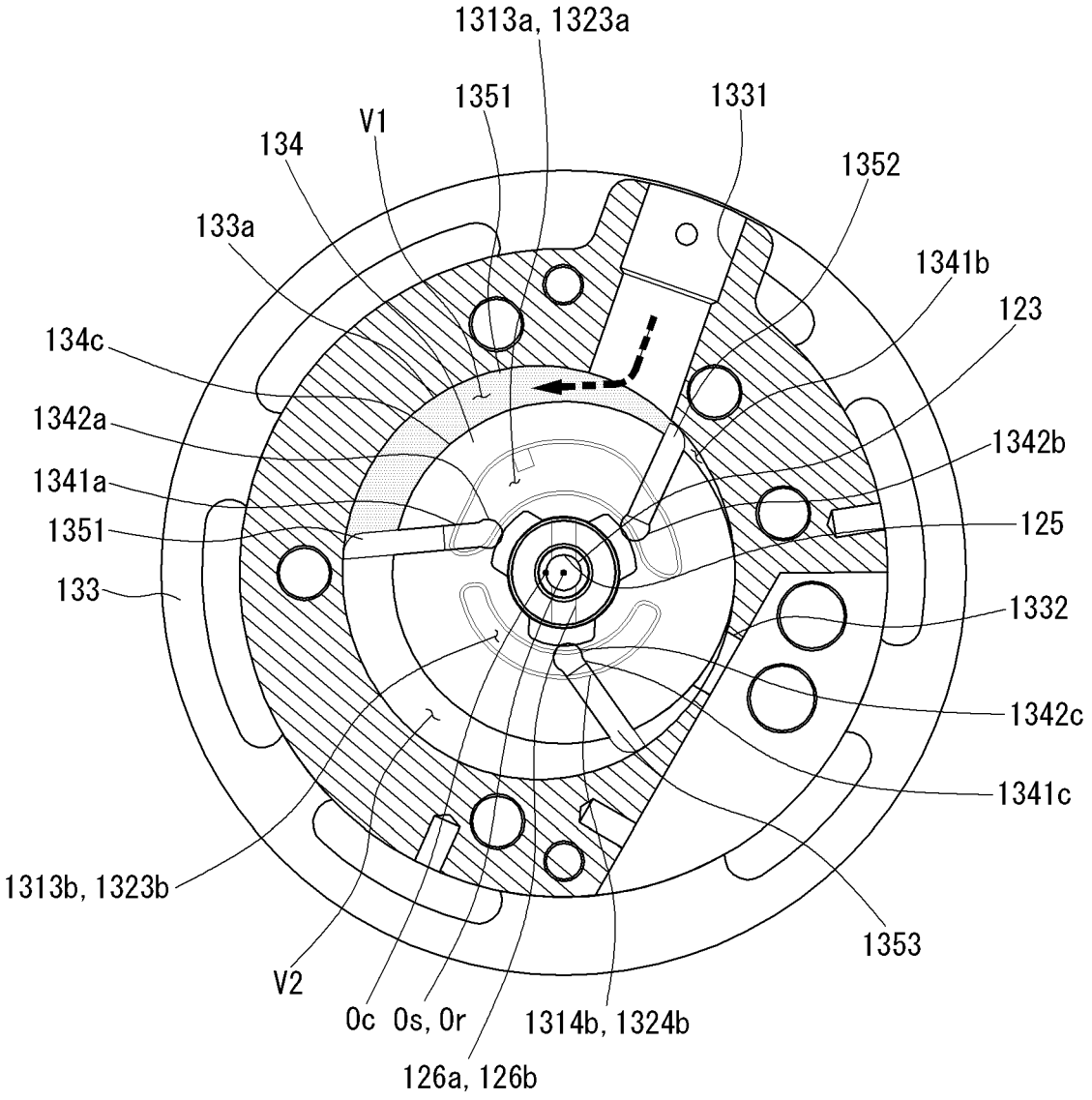
FIGS. 10 to 12 are operational diagrams of the rotary compressor according to an embodiment.
Figure 11:
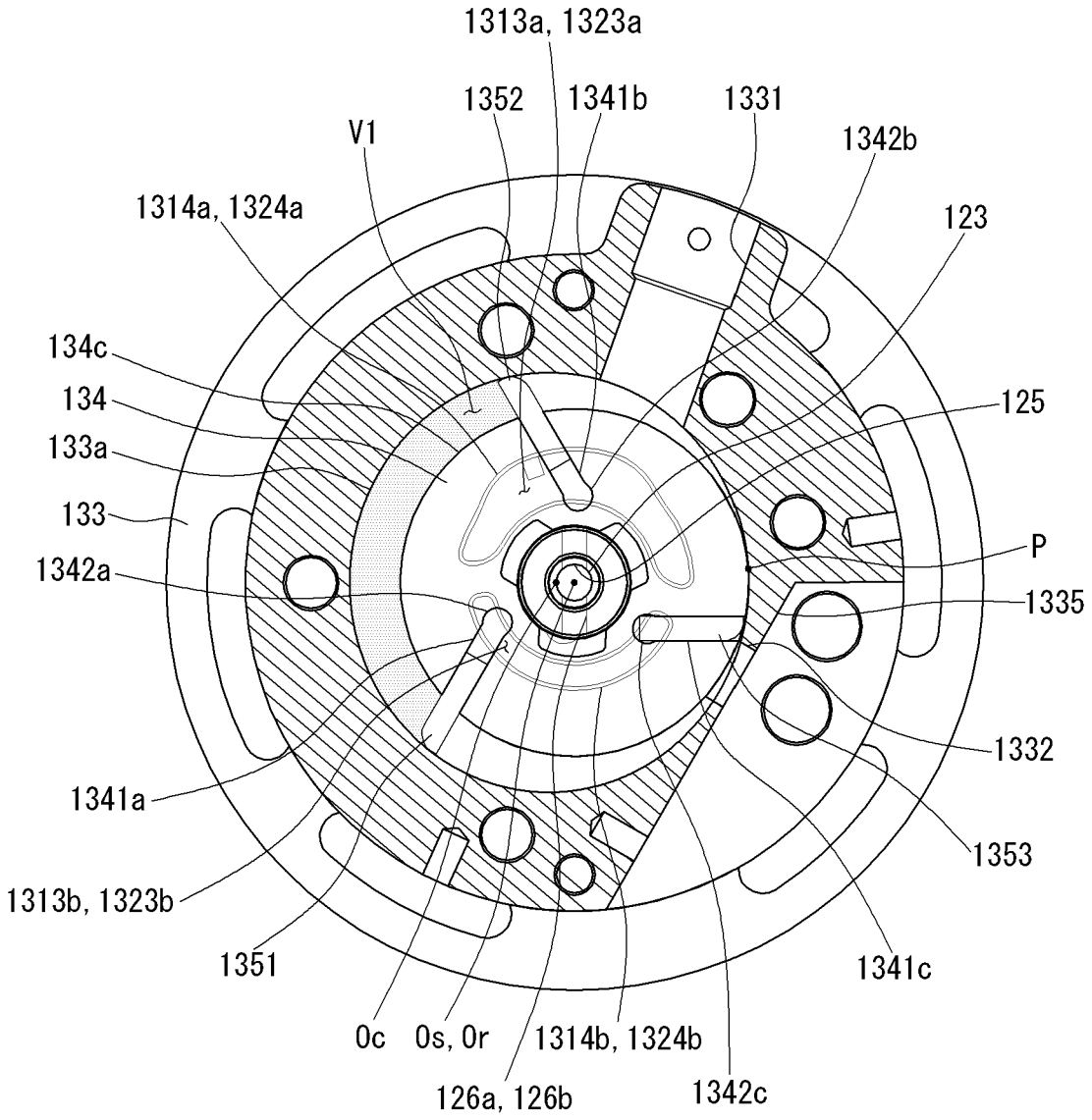
Figure 12:
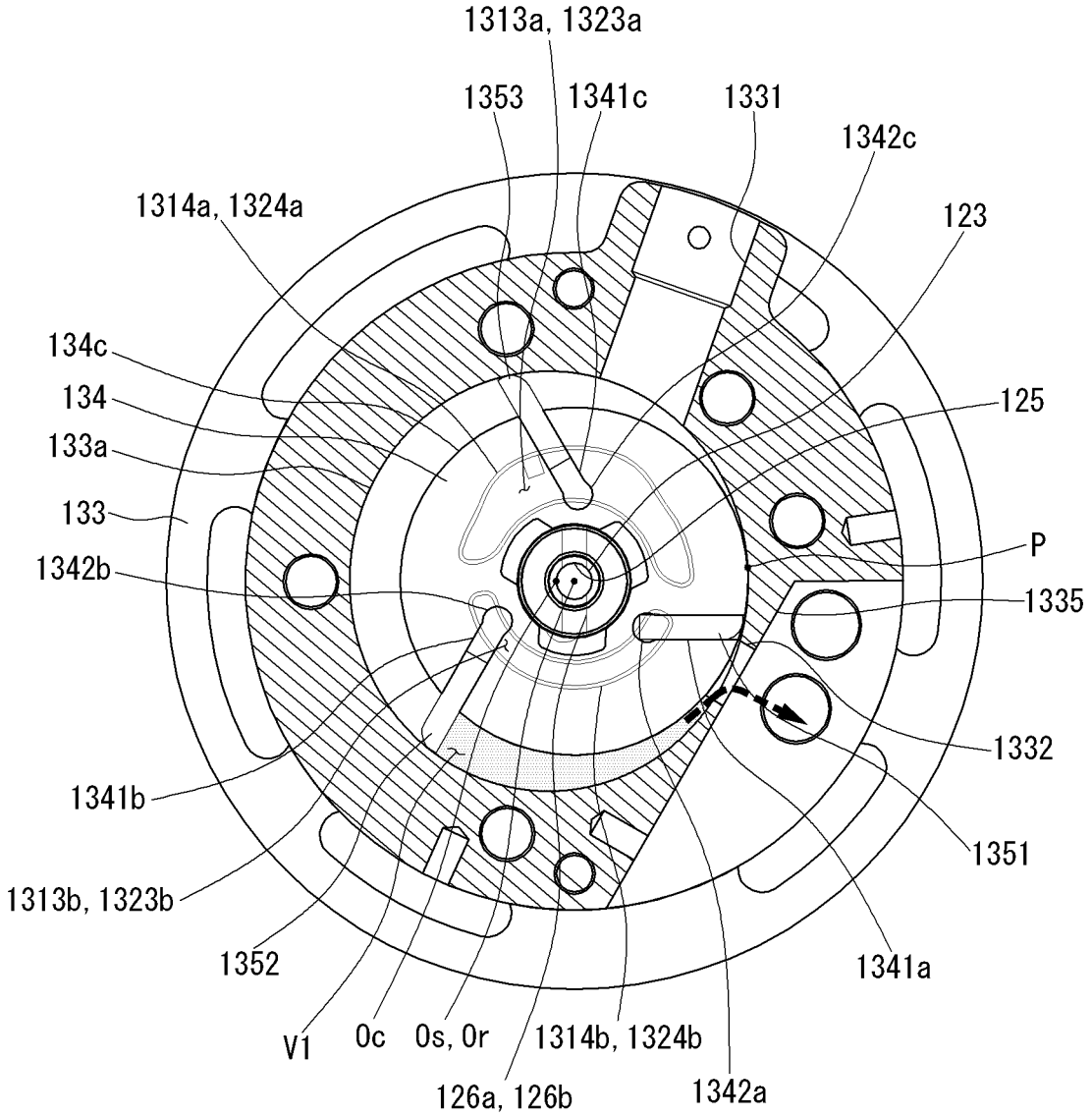

FIG. 1 is a vertical cross-sectional view of a rotary compressor according to an embodiment. FIG. 2 is a transverse cross-sectional view of the rotary compressor according to an embodiment. FIGS. 3 and 4 are exploded perspective views of a partial configuration of the rotary compressor according to an embodiment. FIG. 5 is a cross-sectional view, taken along line V-V' of FIG. 2. FIGS. 6 and 7 are enlarged views of portion B of FIG. 5. FIGS. 8 and 9 are plan views of a partial configuration of the rotary compressor according to an embodiment. FIGS. 10 to 12 are operational diagrams of the rotary compressor according to an embodiment.

Referring to FIGS. 1 to 11, a rotary compressor 100 according to an embodiment may include a casing 110, a drive motor 120, and compression units 131, 132, and 133. However, the rotary compressor 100 may further include additional components.

The casing 110 may form an exterior of the rotary compressor 100. The casing 110 may be formed in a cylindrical shape. The casing 110 may be divided into a vertical type casing or a horizontal type casing according to an installation mode of the rotary compressor 100. The vertical type casing may be a structure in which the drive motor 120 and the compression units 131, 132, 133, and 134 are disposed on upper and lower sides along an axial direction, and the horizontal type casing may be a structure in which the drive motor 120 and the compression units 131, 132, 133, and 134 are disposed on left and right or lateral sides. The drive motor 120, a rotational shaft 123, and the compression units 131, 132, 133, and 134 may be disposed inside of the casing 110. The casing 110 may include an upper shell 110*a*, an intermediate shell 110*b*, and a lower shell 110*c*. The upper shell 110*a*, the intermediate shell 110*b*, and the lower shell 110*c* may seal an inner space S.

The drive motor 120 may be disposed in the casing 110. The drive motor 120 may be fixed inside of the casing 110. The compression units 131, 132, 133, and 134 mechanically coupled by the rotational shaft 123 may be installed on or at one side of the drive motor 120.

The drive motor 120 may provide power to compress a refrigerant. The drive motor 120 may include a stator 121, a rotor 122, and the rotational shaft 123.

The stator 121 may be disposed in the casing 110. The stator 121 may be disposed inside of the casing 110. The stator 121 may be fixed inside of the casing 110. The stator 121 may be mounted on an inner peripheral surface of the cylindrical casing 110 by a method, such as shrink fit, for example. For example, the stator 121 may be fixedly installed on an inner peripheral surface of the intermediate shell 110*b*.

The rotor 122 may be spaced apart from the stator 121. The rotor 122 may be disposed inside of the stator 121. The rotational shaft 123 may be disposed on the rotor 122. The rotational shaft 122 may be disposed at a center of the rotor 122. The rotational shaft 123 may be, for example, press-fitted to the center of the rotor 122.

When power is applied to the stator 121, the rotor 122 may be rotated according to an electromagnetic interaction between the stator 121 and the rotor 122. Accordingly, the rotational shaft 123 coupled to the rotor 122 may rotate concentrically with the rotor 122.

An oil flow path 125 may be formed at a center of the rotational shaft 123. The oil flow path 125 may extend in the axial direction. Oil through holes 126*a* and 126*b* may be formed in a middle of the oil flow path 125 toward an outer peripheral surface of the rotational shaft 123.

The oil through holes 126*a* and 126*b* may include first oil through hole 126*a* belonging to a range of a first bearing portion 1311 and second oil through hole 126*b* belonging to a range of a second bearing portion 1321. One first oil through hole 126*a* and one second oil through hole 126*b* may be formed or a plurality of oil through holes 126*a* and a plurality of oil through holes 126*b* may be formed.

An oil feeder 150 may be disposed in or at a middle or a lower end of the oil flow path 125. When the rotational shaft 123 rotates, oil filling a lower portion of the casing 110 may be pumped by the oil feeder 150. Accordingly, the oil may be raised along the oil flow path 125, may be supplied to a sub bearing surface 1321*a* through the second oil through hole 126*b*, and may be supplied to a main bearing surface 1311*a* through the first oil through hole 126*a*.

The first oil through hole 126*a* may be formed to overlap the first oil groove 1311*b*. The second oil through hole 126*b* may be formed to overlap the second oil groove 1321*b*. That is, oil supplied to the main bearing surface 1311*a* of main bearing 131 of compression units 131, 132, 133, and 134 and a sub bearing surface 1321*a* of sub bearing 132 of compression units 131, 132, 133, and 134 through the first oil through hole 126*a* and the second oil through hole 126*b* may be quickly introduced into a main-side second pocket 1313*b* and a sub-side second pocket 1323*b*.

The compression units 131, 132, 133, and 134 may further include cylinder 133 having a compression space 410 formed by the main bearing 131 and the sub bearing 132 installed on or at both sides in the axial direction, and rotor 134 disposed rotatably inside of the cylinder 133. Referring FIGS. 1 and 2, the main bearing 131 and the sub bearing 132 may be disposed in the casing 110. The main bearing 131 and the sub bearing 132 may be fixed to the casing 110. The main bearing 131 and the sub bearing 132 may be spaced apart from each other along the rotational shaft 123. The main bearing 131 and the sub bearing 132 may be spaced apart from each other in the axial direction. In this embodiment, the axial direction may refer to an up-down or vertical direction with respect to FIG. 1. Moreover, in this embodiment, the main bearing 131 may be referred to as a "first bearing", and the sub bearing 132 may be referred to as a "second bearing".

The main bearing 131 and the sub bearing 132 may support the rotational shaft 123 in a radial direction. The main bearing 131 and the sub bearing 132 may support the cylinder 133 and the rotor 134 in the axial direction. The main bearing 131 and the sub bearing 132 may include the first and second bearing portions 1311 and 1321 which support the rotational shaft 123 in the radial direction, and flange portions (flanges) 1312 and 1322 which extend in the radial direction from the bearing portions 1311 and 1321. More specifically, the main bearing 131 may include the first bearing portion 1311 that supports the rotational shaft 123 in the radial direction and the first flange portion 1312 that extends in the radial direction from the first bearing portion 1311, and the sub bearing 132 may include the second bearing portion 1321 that supports the rotational shaft 123 in the radial direction and the second flange portion 1322 that extends in the radial direction from the second bearing portion 1321.

Each of the first bearing portion 1311 and the second bearing portion 1321 may be formed in a bush shape. Each of the first flange portion 1312 and the second flange portion 1322 may be formed in a disk shape. The first oil groove 1311*b* may be formed on the main bearing surface 1311*a* which is a radially inner peripheral surface of the first bearing portion 1311. The second oil groove 1321*b* may be formed on the sub bearing surface 1321*a* which is a radially inner peripheral surface of the second bearing portion 1321. The first oil groove 1311*b* may be formed in a straight line or an oblique line between upper and lower ends of the first bearing portion 1311. The second oil groove 1321*b* may be formed in a straight line or an oblique line between upper and lower ends of the second bearing portion 1321.

A first communication channel 1315 may be formed in the first oil groove 1311*b*. A second communication channel 1325 may be formed in the second oil groove 1321*b*. The first communication channel 1315 and the second communication channel 1325 may guide oil flowing into the main bearing surface 1311*a* and the sub bearing surface 1321*a* to a main-side back pressure pocket 1313 and a sub-side back pressure pocket 1323.

The main-side back pressure pocket 1313 may be formed in the first flange portion 1312. The sub-side back pressure pocket 1323 may be formed in the second flange portion 1322. The main-side back pressure pocket 1313 may include a main-side first pocket 1313*a* and the main-side second pocket 1313*b*. The sub-side back pressure pocket 1323 may include a sub-side first pocket 1323*a* and the sub-side second pocket 1323*b*. In this embodiment, first pockets 1313*a* and 1323*a* may include main-side first pocket 1313*a* and sub-side first pocket 1323*a*, and second pockets 1313*b* and 1323*b* may include main-side first pocket 1313*b* and sub-side second pocket 1323*b*.

The main-side first pocket 1313*a* and the main-side second pocket 1313*b* may be formed at predetermined intervals along a circumferential direction. The sub-side first pocket 1323*a* and the sub-side second pocket 1323*b* may be formed at predetermined intervals along the circumferential direction.

The main-side first pocket 1313*a* may form a lower pressure than the main-side second pocket 1313*b*, for example, an intermediate pressure between a suction pressure and a discharge pressure. The sub-side first pocket 1323*a* may form a lower pressure than the sub-side second pocket 1323*b*, for example, the intermediate pressure between the suction pressure and the discharge pressure. The pressure of the main-side first pocket 1313*a* and the pressure of the sub-side first pocket 1323*a* may correspond to each other.

As oil passes through a fine passage between a main-side first bearing protrusion 1314*a* and an upper surface 134*a* of the rotor 134 and flows into the main-side first pocket 1313*a*, the pressure in the first main pocket 1313*a* may be reduced and form the intermediate pressure. As oil passes through a fine passage between a sub-side first bearing protrusion 1324*a* and a lower surface 134*b* of the rotor 134 and flows into the sub-side first pocket 1323*a*, the pressure of the sub-side first pocket 1323*a* may be reduced and form the intermediate pressure.

Oil flowing into the main bearing surface 1311*a* through the first oil through hole 126*a* may flow into the main-side second pocket 1313*b* through the first communication flow channel 1315, and thus, the pressure of the main-side second pocket 1313*b* may be maintained at the discharge pressure or similar to the discharge pressure. Oil flowing into the sub bearing surface 1321*a* through the second oil through hole 126*b* may flow into the sub-side second pocket 1323*b* through the second communication channel 1325, and thus, the pressure of the second sub-side pocket 1323*b* may be maintained at the discharge pressure or similar to the discharge pressure.

The inner peripheral surface of the cylinder 133 may be formed in a symmetrical ellipse shape having a pair of long and short axes, or an asymmetrical ellipse shape having several pairs of long and short axes. The inner peripheral surface of the cylinder 133 forming the compression space 410 may be formed in a circular shape. The cylinder 133 may be fastened to the main bearing 131 or the sub bearing 132 fixed to the casing 110 with a bolt.

An empty space portion (empty space) may be formed at a center of the cylinder 133 to form the compression space 410 including an inner peripheral surface. The empty space may be sealed by the main bearing 131 and the sub bearing 132 to form the compression space 410. The rotor 134 having an outer peripheral surface formed in a circular shape may be rotatably disposed in the compression space 410.

A suction port 1331 and a discharge port 1332 may be respectively formed on an inner peripheral surface 133*a* of the cylinder 133 on both sides in the circumferential direction about a contact point P at which the inner peripheral surface 133*a* of the cylinder 133 and an outer peripheral surface 134*c* of the rotor 134 are in close substantial contact with each other. The suction port 1331 and the discharge port 1332 may be spaced apart from each other. That is, the suction port 1331 may be formed on an upstream side based on a compression path (rotational direction), and the discharge port 1332 may be formed on a downstream side in a direction in which the refrigerant is compressed.

The suction port 1331 may be directly coupled to a suction pipe 113 that passes through the casing 110. The discharge port 1332 may be indirectly coupled with a discharge pipe 114 that communicates with the internal space S of the casing 110 and is coupled to pass through the casing 110. Accordingly, refrigerant may be directly suctioned into the compression space 410 through the suction port 1331, and the compressed refrigerant may be discharged to the internal space S of the casing 110 through the discharge port 1332 and then discharged to the discharge pipe 114. Therefore, the internal space S of the casing 110 may be maintained in a high-pressure state forming the discharge pressure.

More specifically, a high-pressure refrigerant discharged from the discharge port 1332 may stay in the internal space S adjacent to the compression units 131, 132, 133 and 134. As the main bearing 131 is fixed to the inner peripheral surface of the casing 110, upper and lower sides of the internal space S of the casing 110 may be bordered or enclosed. In this case, the high-pressure refrigerant staying in the internal space S may flow through a discharge channel 1316 and be discharged to the outside through the discharge pipe 114 provided on or at the upper side of the casing 110.

The discharge channel 1316 may penetrate the first flange portion 1312 of the main bearing 131 in the axial direction. The discharge channel 1316 may secure a sufficient channel area so that no channel resistance occurs. More specifically, the discharge channel 1316 may extend along the circumferential direction in a region which does not overlap with the cylinder 133 in the axial direction. That is, the discharge channel 1316 may be formed in an arc shape.

In addition, the discharge channel 1316 may include a plurality of holes spaced apart in the circumferential direction. As described above, as the maximum channel area is secured, channel resistance may be reduced when the high-pressure refrigerant moves to the discharge pipe 114 provided on the upper side of the casing 110.

Further, while a separate suction valve is not installed in the suction port 1331, a discharge valve 1335 to open and close the discharge port 1332 may be disposed in the discharge port 1332. The discharge valve 1335 may include a reed valve having one (first) end fixed and the other (second) end forming a free end. Alternatively, the discharge valve 1335 may be variously changed as needed, and may be, for example, a piston valve.

When the discharge valve 1335 is a reed valve, a discharge groove (not illustrated) may be formed on the outer peripheral surface of the cylinder 133 so that the discharge valve 1335 may be mounted therein. Accordingly, a length of the discharge port 1332 may be reduced to a minimum, and thus, dead volume may be reduced. At least portion of the valve groove may be formed in a triangular shape to secure a flat valve seat surface, as illustrated in FIG. 2.

In this embodiment, one discharge port 1332 is provided as an example; however, embodiments are not limited thereto, and a plurality of discharge ports 1332 may be provided along a compression path (compression progress direction).

The rotor 134 may be disposed on the cylinder 133. The rotor 134 may be disposed inside of the cylinder 133. The rotor 134 may be disposed in the compression space 410 of the cylinder 133. The outer peripheral surface 134*c* of the rotor 134 may be formed in a circular shape. The rotational shaft 123 may be disposed at the center of the rotor 134. The rotational shaft 123 may be integrally coupled to the center of the rotor 134. Accordingly, the rotor 134 has a center $O_r$ which matches an axial center $O_s$ of the rotational shaft 123, and may rotate concentrically together with the rotational shaft 123 around the center $O_r$ of the rotor 134.

The center $O_r$ of the rotor 134 may be eccentric with respect to a center $O_c$ of the cylinder 133, that is, the center $O_c$ of the internal space of the cylinder 133. One side of the outer peripheral surface 134*c* of the rotor 134 may almost come into contact with the inner peripheral surface 133*a* of the cylinder 133. The outer peripheral surface 134*c* of the rotor 134 does not actually come into contact with the inner peripheral surface 133*a* of the cylinder 133. That is, the outer peripheral surface 134*c* of the rotor 134 and the inner peripheral surface of the cylinder 133 are spaced apart from each other so that frictional damage does not occur, but should be close to each other so as to limit leakage of high-pressure refrigerant in a discharge pressure region to a suction pressure region through between the outer peripheral surface 134*c* of the rotor 134 and the inner peripheral surface 133*a* of the cylinder 133. A point at which one side of the rotor 134 is almost in contact with the cylinder 133 may be regarded as the contact point P.

The rotor 134 may have at least one vane slot 1341*a*, 1341*b*, and 1341*c* formed at an appropriate location of the outer peripheral surface 134*c* along the circumferential direction. The vane slots 1341*a*, 1341*b*, and 1341*c* may include first vane slot 1341*a*, second vane slot 1341*b*, and third vane slot 1341*c*. In this embodiment, three vane slots 1341*a*, 1341*b*, and 1341*c* are described as an example. However, embodiments are not limited thereto and the vane slot may be variously changed according to a number of vanes 1351, 1352, and 1353.

Each of the first to third vanes 1351, 1352, and 1353 may be slidably coupled to each of the first to third vane slots 1341*a*, 1341*b*, and 1341*c*. In this embodiment, a straight line extending from the first to third vane slots 1341*a*, 1341*b*, and 1341*c* does not pass through the center $O_r$ of the rotor 134 as an example. Each of the first to third vane slots 1341*a*, 1341*b*, and 1341*c* may be formed toward a radial direction with respect to the center $O_r$ of the rotor 134. That is, an extending straight line of each of the first to third vane slots 1341*a*, 1341*b*, and 1341*c* may pass through the center $O_r$ of the rotor 134, respectively.

First to third back pressure chambers 1342*a*, 1342*b*, and 1342*c* may be respectively formed on inner ends of the first to third vane slots 1341*a*, 1341*b*, and 1341*c*, so that the first to third vanes 1351, 1352, and 1353 allows oil or refrigerant to flow into a rear side and the first to third vanes 1351, 1352, and 1353 may be biased in a direction of the inner peripheral surface of the cylinder 133. The first to third back pressure chambers 1342*a*, 1342*b*, and 1342*c* may be sealed by the main bearing 131 and the sub bearing 132. The first to third back pressure chambers 1342*a*, 1342*b*, and 1342*c* may each independently communicate with the back pressure pockets 1313 and 1323. Alternatively, the first to third back pressure chambers 1342*a*, 1342*b*, and 1342*c* may communicate with each other by the back pressure pockets 1313 and 1323.

The back pressure pockets 1313 and 1323 may be formed on the main bearing 131 and the sub bearing 132, respectively, as illustrated in FIG. 1. Alternatively, the back pressure pockets 1313 and 1323 may be formed only on any one of the main bearing 131 or the sub bearing 132. In this embodiment, the back pressure pockets 1313 and 1323 are formed in both the main bearing 131 and the sub bearing 132 as an example. The back pressure pockets 1313 and 1323 may include the main-side back pressure pocket 1313 formed in the main bearing 131 and the sub-side back pressure pocket 1323 formed in the sub bearing 132.

The main-side back pressure pocket 1313 may include the main-side first pocket 1313*a* and the main-side second pocket 1313*b*. The main-side second pocket 1313*b* may generate a higher pressure than the main-side first pocket 1313*a*. The sub-side back pressure pocket 1323 may include the sub-side first pocket 1323*a* and the sub-side second pocket 1323*b*. The sub-side second pocket 1323*b* may generate a higher pressure than the sub-side first pocket 1323*a*. Accordingly, the main-side first pocket 1313*a* and the sub-side first pocket 1323*a* may communicate with a vane chamber to which a vane located at a relatively upstream side (from the suction stroke to the discharge stroke) among the vanes 1351, 1352, and 1353 belongs, and the main-side second pocket 1313*b* and the sub-side second pocket 1323*b* may communicate with a vane chamber to which a vane located at a relatively downstream side (from the discharge stroke to the suction stroke) among the vanes 1351, 1352, and 1353 belongs.

In the first to third vanes 1351, 1352, and 1353, the vane closest to the contact point P based on a compression progress direction may be referred to as the first vane 1351, and the following vanes may be referred to as the second vane 1352 and the third vane 1353. In this case, the first vane 1351 and the second vane 1352, the second vane 1352 and the third vane 1353, and the third vane 1353 and the first vane 1351 may be spaced apart from each other by a same circumferential angle.

Referring to FIG. 2, when a compression chamber formed by the first vane 1351 and the second vane 1352 is referred to as a "first compression chamber V1", a compression chamber formed by the second vane 1352 and the third vane 1353 is referred to as a "second compression chamber V2", and the compression chamber formed by the third vane 1353 and the first vane 1351 is referred to as a "third compression chamber V3", all of the compression chambers V1, V2, and V3 have a same volume at a same crank angle. The first compression chamber V1 may be referred to as a suction chamber, and the third compression chamber V3 may be referred to as a discharge chamber.

Each of the first to third vanes 1351, 1352, and 1353 may be formed in a substantially rectangular parallelepiped shape. Referring to ends of each of the first to third vanes 1351, 1352, and 1353 in the longitudinal direction, a surface in contact with the inner peripheral surface 133*a* of the cylinder 133 may be referred to as a "distal end surface", and a surface facing each of the first to third back pressure chambers 1342*a*, 1342*b*, and 1342*c* may be referred to as a "rear end surface". The distal end surface of each of the first to third vanes 1351, 1352, and 1353 may be formed in a curved shape so as to come into line contact with the inner peripheral surface 133*a* of the cylinder 133. The rear end surface of each of the first to third vanes 1351, 1352, and 1353 may be formed to be flat to be inserted into each of the first to third back pressure chambers 1342*a*, 1342*b*, and 1342*c* and to receive the back pressure evenly.

In the rotary compressor 100, when power is applied to the drive motor 120 and the rotor 122 and the rotational shaft 123 rotate, the rotor 134 rotates together with the rotational shaft 123. In this case, each of the first to third vanes 1351, 1352, 1353 may be withdrawn from each of the first to third vane slots 1341*a*, 1341*b*, and 1341*c*, due to centrifugal force generated by rotation of the rotor 134 and a back pressure of each of the first to third back pressure chambers 1342*a*, 1342*b*, and 1342*c* disposed at a rear side of each of the first to third back pressure chambers 1342*a*, 1342*b*, and 1342*c*. Accordingly, the distal end surface of each of the first to third vanes 1351, 1352, and 1353 comes into contact with the inner peripheral surface 133*a* of the cylinder 133.

In this embodiment, the distal end surface of each of the first to third vanes 1351, 1352, and 1353 is in contact with the inner peripheral surface 133*a* of the cylinder 133 may mean that the distal end surface of each of the first to third vanes 1351, 1352, and 1353 comes into direct contact with the inner peripheral surface 133*a* of the cylinder 133, or the distal end surface of each of the first to third vanes 1351, 1352, and 1353 is adjacent enough to come into direct contact with the inner peripheral surface 133*a* of the cylinder 133.

The compression space 410 of the cylinder 133 forms a compression chamber (including suction chamber or discharge chamber) (V1, V2, V3) by the first to third vanes 1351, 1352, and 1353, and a volume of each of the compression chambers V1, V2, V3 may be changed by eccentricity of the rotor 134 while moving according to rotation of the rotor 134. Accordingly, while the refrigerant filling each of the compression chambers V1, V2, and V3 moves along the rotor 134 and the vanes 1351, 1352, and 1353, the refrigerant is suctioned, compressed, and discharged.

In this embodiment, it is described as an example that there are three vanes 1351, 1352, and 1353, three vane slots 1341*a*, 1341*b*, and 1341*c*, and three back pressure chambers 1342*a*, 1342*b*, and 1342*c*. However, the number of the vanes 1351, 1352, and 1353, the number of vane slots 1341*a*, 1341*b*, and 1341*c*, and the number of back pressure chambers 1342*a*, 1342*b*, and 1342*c* may be variously changed.

Referring FIGS. 6 and 7, a length d2 of each of the vanes 1351, 1352, and 1353 overlapping an upper surface or a lower surface of each of the bearings 131 and 132 in the axial direction may be between 0.6 times to 1 time a radial length d1 of the upper surface or the lower surface of each of the vanes 1351, 1352, and 1353. When the length d2 of each of the vanes 1351, 1352, and 1353 overlapping the upper surface or the lower surface of each of the bearings 131 and 132 in the axial direction is smaller than 0.6 times the radial length d1 of the upper surface or the lower surface of each of the vanes 1351, 1352, and 1353, a space between the distal end surface of each of the vanes 131, 1352, and 1353 and the inner peripheral surface of the cylinder 133 is widened, and thus, there is a concern that refrigerant may leak.

Moreover, a length d3 of the upper surface or the lower surface of each of the vanes 1351, 1352, and 1353 overlapping each of the bearings 131 and 132 in the radial direction may be equal to or less than a length d4 of the upper surface or the lower surface of each of the vanes 1351, 1352, and 1353 overlapping the cylinder 133 in the radial direction. When the length d3 of the upper surface or the lower surface of each of the vanes 1351, 1352, and 1353 overlapping each of the bearings 131 and 132 in the radial direction is more than the length d4 of the upper surface or the lower surface of each of the vanes 1351, 1352, and 1353 overlapping the cylinder 133 in the radial direction, a space between the distal end surface of each of the vanes 131, 1352, and 1353 and the inner peripheral surface of the cylinder 133 is widened, and thus, there is a concern that refrigerant may leak. Accordingly, behavior of each of the vanes 1351, 1352, and 1353 may be stabilized, refrigerant prevented from leaking into the space between the distal end surface of each of the vanes 1351, 1352, and 1353 and the inner peripheral surface of the cylinder 133, and thus, compression efficiency may be improved.

Referring to FIGS. 2, 8, and 9, each of the first pockets 1313*a* and 1323*a* may be formed in an asymmetrical shape. An outer diameter of each of the first pockets 1313*a* and 1323*a* may decrease toward the discharge port 1332. Each of the second pockets 1313*b* and 1323*b* may be formed in an asymmetrical shape, and an outer diameter of each of the second pockets 1313*b* and 1323*b* may decrease toward the discharge port 1332. Accordingly, the behavior of each of the vanes 1351, 1352, and 1353 may be stabilized, refrigerant prevented from leaking into the space between the distal end surface of each of the vanes 1351, 1352, and 1353 and the inner peripheral surface of the cylinder 133, and thus, compression efficiency may be improved.

As described above, each of the first pockets 1313*a* and 1323*a* and each of the second pockets 1313*b* and 1323*b* may have different pressures. More specifically, a pressure in each of the second pockets 1313*b* and 1323*b* may be higher than a pressure in each of the first pockets 1313*a* and 1323*a*. Accordingly, it is possible to decrease a size of a product.

Referring to FIGS. 8 and 9, the second pockets 1313*b* and 1323*b* may be disposed closer to the rotational shaft 123 than the first pockets 1313*a* and 1323*a*. The second pockets 1313*b* and 1323*b* may communicate with the through holes 1317 and 1327. In this embodiment, the through hole 1317 and 1327 may include first through hole 1317 through which the rotational shaft 123 passes in the main bearing 131, and second through hole 1327 through which the rotational shaft 123 passes in the sub bearing 132. Accordingly, compression efficiency of the rotary compressor 100 may be improved.

A process in which refrigerant is suctioned from the cylinder 133, compressed, and discharged according to an embodiment will be described with reference to FIGS. 10 to 12.

Referring to FIG. 10, the volume of the first compression chamber V1 is continuously increases until the first vane 1351 passes through the suction port 1331 and the second vane 1352 reaches a completion point of suction w. In this case, the refrigerant may continuously flow into the first compression chamber V1 from the suction port 1331.

Referring to FIG. 11, when the first vane 1351 passes the completion point of suction (or the start point of compression) and proceeds to the compression stroke, the first compression chamber V1 may be sealed and may move in a direction of the discharge port 1332 together with the rotor 134. In this process, the volume of a first compression chamber V1 continuously decreases, and refrigerant in the first compression chamber V1 may be gradually compressed.

Referring to FIG. 12, when the second vane 1352 passes through the discharge port 1332 and the first vane 1351 does not reach the discharge port 1332, the discharge valve 1335 may be opened by the pressure of the first compression chamber V1 while the first compression chamber V1 communicates with the discharge port 1332. In this case, the refrigerant in the first compression chamber V1 may be discharged to the internal space of the casing 110 through the discharge port 1332.

The intermediate pressure between the suction pressure and the discharge pressure may be formed in the main-side first pocket 1313*a*, and the discharge pressure (actually, a pressure slightly lower than the discharge pressure) may be formed in the main-side second pocket 1313*b*. Accordingly, the intermediate pressure lower than the discharge pressure is formed in the main-side first pocket 1313*a*, and thus, mechanical efficiency between the cylinder 133 and the vanes 1351, 1352, and 1353 may increase. In addition, the discharge pressure or the pressure slightly lower than the discharge pressure is formed in the main second pocket 1313*b*, and thus, the vanes 1351, 1352, and 1353 are disposed adjacent to the cylinder 133 to increase the mechanical efficiency while suppressing leakage between the compression chambers and increasing efficiency.

Certain or other embodiments described are not mutually exclusive or distinct. In certain embodiments or other embodiments described above, their respective configurations or functions may be used together or combined with each other.

For example, it means that a configuration A described in a specific embodiment and/or a drawing may be coupled to a configuration B described in another embodiment and/or a drawing. That is, even if a combination between components is not directly described, it means that the combination is possible except for a case where it is described that the combination is impossible.

The above description should not be construed as restrictive in all respects and should be considered as illustrative. A scope should be determined by rational interpretation of the appended claims, and all changes within the equivalent scope are included in the scope.

According to embodiments disclosed herein, it is possible to provide a rotary compressor capable of preventing refrigerant from leaking into a space between a distal end surface of a vane and an inner peripheral surface of a cylinder to improve compression efficiency.

Embodiments disclosed herein provide a rotary compressor capable of preventing refrigerant from leaking into a space between a distal end surface of a vane and an inner peripheral surface of a cylinder to improve compression efficiency.

Embodiments disclosed herein provide a rotary compressor that may include a rotational shaft; first and second bearings configured to support the rotational shaft in a radial direction; a cylinder disposed between the first and second bearings to form a compression space; a rotor disposed in the compression space and coupled to the rotational shaft to compress a refrigerant as the rotor rotates; and at least one vane slidably inserted into the rotor, the at least one vane coming into contact with an inner peripheral surface of the cylinder to separate the compression space into a plurality of regions. At least one of the first bearing or the second bearing may include first and second pockets formed on a surface facing the rotor, and at least one of the first pocket or the second pocket may be formed in an asymmetrical shape. Accordingly, it is possible to prevent refrigerant from leaking into the space between the distal end surface of the vane and the inner peripheral surface of the cylinder to improve compression efficiency.

A length the vane overlapping an upper surface or a lower surface of the bearing in an axial direction may be 0.6 time to 1 time a radial length of an upper surface or a lower surface of the vane. Further, a length of an upper surface or a lower surface of the vane overlapping the first or second bearing in the radial direction may be shorter than a length of the upper surface or the lower surface of the vane overlapping the cylinder in the radial direction.

A pressure in the first pocket may be different from a pressure in the second pocket. The pressure in the second pocket may be higher than the pressure in the first pocket.

The cylinder may include a discharge port through which refrigerant compressed in the compression space may be discharged. At least a portion of an outer diameter of at least one of the first pocket or the second pocket may decrease toward the discharge port. The second pocket may be located closer to the rotational shaft than the first pocket.

The first and second bearings may include a through hole through which the rotational shaft passes. The second pocket may communicate with the through hole.

A center of the rotor may be eccentric to a center of the inner peripheral surface of the cylinder. The inner peripheral surface of the cylinder may be formed in an ellipse shape.

Embodiments disclosed herein provide a rotary compressor that may include a rotational shaft; first and second bearings configured to support the rotational shaft in a radial direction; a cylinder disposed between the first and second bearings to form a compression space; a rotor disposed in the compression space and coupled to the rotational shaft to compress a refrigerant as the rotor rotates; and at least one vane slidably inserted into the rotor, the at least one vane coming into contact with an inner peripheral surface of the cylinder to separate the compression space into a plurality of regions. At least one of the first bearing and the second bearing may include first and second pockets formed on a surface facing the rotor, and a length of the vane overlapping an upper surface or a lower surface of the bearing in an axial direction is 0.6 time to 1 time a radial length of an upper surface or a lower surface of the vane. Accordingly, it is possible to prevent refrigerant from leaking into the space between the distal end surface of the vane and the inner peripheral surface of the cylinder to improve compression efficiency.

At least one of the first and second pockets may be formed in an asymmetrical shape. A length of an upper surface or a lower surface of the vane overlapping the first or second bearing in the radial direction may be shorter than a length of the upper surface or the lower surface of the vane overlapping the cylinder in the radial direction.

A pressure in the first pocket may be different from a pressure in the second pocket. The pressure in the second pocket may be higher than the pressure in the first pocket.

The cylinder may include a discharge port through which refrigerant compressed in the compression space is discharged, and at least a portion of an outer diameter of at least one of the first pocket and the second pocket may decrease toward the discharge port. The second pocket may be located closer to the rotational shaft than the first pocket.

The first and second bearings may include a through hole through which the rotational shaft passes. The second pocket may communicate with the through hole.

A center of the rotor may be eccentric to a center of the inner peripheral surface of the cylinder. The inner peripheral surface of the cylinder may be formed in an ellipse shape.

It will be understood that when an element or layer is referred to as being "on" another element or layer, the element or layer can be directly on another element or layer or intervening elements or layers. In contrast, when an element is referred to as being "directly on" another element or layer, there are no intervening elements or layers present. As used herein, the term "and/or" includes any and all combinations of one or more of the associated listed items.

It will be understood that, although the terms first, second, third, etc., may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section could be termed a second element, component, region, layer or section without departing from the teachings.

Spatially relative terms, such as "lower", "upper" and the like, may be used herein for ease of description to describe the relationship of one element or feature to another element(s) or feature(s) as illustrated in the figures. It will be understood that the spatially relative terms are intended to encompass different orientations of the device in use or operation, in addition to the orientation depicted in the figures. For example, if the device in the figures is turned over, elements described as "lower" relative to other elements or features would then be oriented "upper" relative to the other elements or features. Thus, the exemplary term "lower" can encompass both an orientation of above and below. The device may be otherwise oriented (rotated 90 degrees or at other orientations) and the spatially relative descriptors used herein interpreted accordingly.

The terminology used herein is for the purpose of describing particular embodiments only and is not intended to be limiting. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Embodiments are described herein with reference to cross-section illustrations that are schematic illustrations of idealized embodiments (and intermediate structures). As such, variations from the shapes of the illustrations as a result, for example, of manufacturing techniques and/or tolerances, are to be expected. Thus, embodiments should not be construed as limited to the particular shapes of regions illustrated herein but are to include deviations in shapes that result, for example, from manufacturing.

Unless otherwise defined, all terms (including technical and scientific terms) used herein have the same meaning as commonly understood by one of ordinary skill in the art to which embodiments belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Any reference in this specification to "one embodiment," "an embodiment," "example embodiment," etc., means that a particular feature, structure, or characteristic described in connection with the embodiment is included in at least one embodiment. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A rotary compressor, comprising:

a rotational shaft;

a first bearing and a second bearing configured to support the rotational shaft in a radial direction;

a cylinder disposed between the first bearing and the second bearing to form a compression space;

a rotor disposed in the compression space, forming a contact point between an outer circumferential surface of the rotor and an inner circumferential surface of the cylinder, and coupled to the rotational shaft to compress a refrigerant as the rotor rotates; and at least one vane slidably inserted into the rotor, the at least one vane coming into contact with the inner circumferential surface of the cylinder to separate the compression space into a plurality of regions, wherein the rotor comprises at least one vane slot into which the at least one vane is inserted, wherein the at least one vane slot comprises a back pressure chamber defined in an inner end of the at least one vane slot, wherein at least one of the first bearing or the second bearing comprises a first pocket and a second pocket formed on a surface that faces the rotor to communicate with the back pressure chamber, and wherein the first pocket and the second pocket are respectively formed in an asymmetrical shape, such that at least a portion of an outer diameter of the first pocket and the second pocket are respectively reduced toward the contact point.

2. The rotary compressor of claim 1, wherein a length of the at least one vane overlapping an upper surface or a lower surface of the first bearing or the second bearing in an axial direction is 0.6 time to 1 time a radial length of an upper surface or a lower surface of the at least one vane.

3. The rotary compressor of claim 1, wherein a length of an upper surface or a lower surface of the at least one vane overlapping the first bearing or the second bearing in the radial direction is shorter than a length of the upper surface or the lower surface of the at least one vane overlapping the cylinder in the radial direction.

4. The rotary compressor of claim 1, wherein a pressure in the first pocket is different from a pressure in the second pocket.

5. The rotary compressor of claim 4, wherein the pressure in the second pocket is higher than the pressure in the first pocket.

6. The rotary compressor of claim 1, wherein the cylinder comprises a discharge port through which the refrigerant compressed in the compression space is discharged, and wherein at least a portion of the outer diameter of the first pocket or the second pocket decreases toward the discharge port, respectively.

7. The rotary compressor of claim 6, wherein the cylinder comprises a suction port formed on the inner circumferential surface of the cylinder, and wherein the refrigerant is suctioned in the compression space through the suction port.

8. The rotary compressor of claim 7, wherein the suction port and the discharge port are respectively formed on both sides in a circumferential direction of the cylinder about the contact point.

9. The rotary compressor of claim 8, wherein the suction port and the discharge port are spaced apart from each other.

10. The rotary compressor of claim 8, wherein the suction port is formed on an upstream side based on a compression path, and wherein the discharge port is formed on a downstream side based on the compression path.

11. The rotary compressor of claim 1, wherein the second pocket is located closer to the rotational shaft than the first pocket.

12. The rotary compressor of claim 1, wherein the first bearing and the second bearing each comprises a through hole through which the rotational shaft passes, and wherein the second pocket communicates with the through hole.

13. The rotary compressor of claim 1, wherein a center of the rotor is eccentric to a center of the inner circumferential surface of the cylinder.

14. The rotary compressor of claim 1, wherein the inner circumferential surface of the cylinder is formed in an ellipse shape.

15. The rotary compressor of claim 1, wherein the first bearing includes a first bearing portion that supports the rotational shaft in the radial direction and a first flange portion that extends from the first bearing portion in the radial direction, and wherein the second bearing includes a second bearing portion that supports the rotational shaft in the radial direction and a second flange portion that extends from the second bearing portion in the radial direction.

16. The rotary compressor of claim 15, wherein the first pocket and the second pocket are formed on the surface that faces the rotor to communicate with the back pressure chamber, the surface is at least one of the first flange portion of the first bearing or the second flange portion of the second bearing.

* * * * *